US005539438A

United States Patent [19]

Maeda

[11] Patent Number: 5,539,438

[45] Date of Patent: Jul. 23, 1996

[54] IMAGE FORMING APPARATUS HAVING AN APERTURE ELECTRODE AND LOW FRICTION TONER SUPPLYING DEVICE

[75] Inventor: Masataka Maeda, Konan, Japan

[73] Assignee: Brother Kogyo Kabushiki Kaisha, Nagoya, Japan

[21] Appl. No.: 273,925

[22] Filed: Jul. 12, 1994

[30] Foreign Application Priority Data

Oct. 25, 1993 [JP] Japan ..... 5-266007

[51] Int. Cl.[6] ..... B41J 2/06

[52] U.S. Cl. ..... 347/55

[58] Field of Search ..... 347/55, 120, 123, 347/127; 355/200, 245

[56] References Cited

U.S. PATENT DOCUMENTS

| | | | |
|---|---|---|---|
| 3,689,935 | 9/1972 | Pressman et al. | 347/55 |
| 4,635,074 | 1/1987 | Young | 347/55 X |
| 5,036,341 | 7/1991 | Larsson | 347/55 |
| 5,153,611 | 10/1992 | Kokado et al. | 347/55 |
| 5,170,185 | 12/1992 | Takemura et al. | 347/55 |
| 5,200,769 | 4/1993 | Takemura et al. | 347/55 X |
| 5,404,155 | 4/1995 | Kitamura | 347/55 X |

*Primary Examiner*—John E. Barlow, Jr.
*Attorney, Agent, or Firm*—Oliff & Berridge

[57] ABSTRACT

An image forming apparatus uses an electrode member with apertures therein through which toner is passed according to an image to a support medium. A toner carrier member has a low friction layer contacting the surface of an electrode member. The low friction layer is made of molybdenum disulfide or a similar solid lubricant. Friction between the surface of the low friction layer directly contacting the electrode member and toner particles is so small that the attachment force of the toner particles is small. Therefore, by using a small potential the electrode can be controlled for selectively passing toner particles through the apertures. As a result, a low cost driving element can be used for the image forming apparatus.

16 Claims, 2 Drawing Sheets

IMAGE FORMING APPARATUS HAVING AN APERTURE ELECTRODE AND LOW FRICTION TONER SUPPLYING DEVICE

BACKGROUND OF THE INVENTION

1. Field of the Invention

The invention relates to an image forming apparatus with an electrode unit having a plurality of apertures for use in a copying machine, a printer, a plotter, a facsimile machine, or other apparatus having a printing function.

2. Description of the Related Art

Heretofore, there has been conventionally proposed an image forming apparatus in which an image is formed using a plurality of apertures. In this image forming apparatus, a voltage is selectively applied to the apertures in accordance with image data to control toner particles to selectively pass through the apertures. The toner particles which pass through the apertures form an image on an image forming medium. This type of an image forming apparatus is disclosed in the U.S. Pat. No. 3,689,935.

The image forming apparatus includes an aperture electrode having a plain plate made of an insulating material, a continuous reference electrode formed on a one side of the plain plate and a segmented control electrode formed on the other side of the plain plate. Control electrodes of the segmented control electrode are insulated from each other and the aperture electrode is formed as at least one row of apertures through the three layers including each control electrode of the segmented control electrode. The image forming apparatus further comprises a power supply for selectively supplying an electric potential between the reference electrode and the segmented control electrode, a toner supplier for supplying toner particles so that the density of the particle stream is modulated according to the pattern of the potentials applied to the control electrodes of the segmented control electrode, and positioning means for positioning a print receiving medium in the particle stream by relatively moving the print receiving medium and the aperture electrode.

However, the conventional apparatus does not achieve high speed printing and further has a reduced printing quality due to blinding of the apertures.

The applicant proposed an improved apparatus of this image forming apparatus in the U.S. patent application Ser. No. 08/112,471, filed on Aug. 28, 1993. The apparatus of the application improves the printing characteristic by contacting an aperture electrode with a toner carry means carrying the toner. In the apparatus, toner particles are supplied concurrently with contacting the toner around the apertures of the aperture electrode so that toner which causes the blinding of the apertures doesn't accumulate in the apertures. Consequently the apertures of the aperture electrode aren't blinded.

In the apparatus of the application, the toner particles are attached to toner carrier means by image-force or Van der Waals force. To detach the toner particles from the toner carrier means and pass the toner particles through the apertures during a printing operation, a high driving voltage is required. Therefore, the printing apparatus, including a driving element with a high output voltage, becomes expensive.

SUMMARY OF THE INVENTION

It is therefore an object of the invention to overcome the above and other deficiencies and disadvantages of the related art and to provide an inexpensive image forming apparatus capable of forming high quality images by using a low cost driving element as result of making the switching voltage difference small.

In carrying out the invention and according to one aspect thereof, there is provided a image forming apparatus comprising: a toner supply that supplies charged toner particles, including a toner carrier member; an image support that supports an image formed of charged toner particles based on image data; and a toner flow control member disposed between the toner supply and the image support, the toner flow control member directly contacting said toner carrier member on one surface, the toner flow control member including a plurality of apertures surrounded by control electrodes that create an electric field to selectively draw charged toner particles through said apertures, wherein the friction between the surface of the toner flow control member directly contacting the toner carrier member and the toner particles is larger than the friction between the surface of the toner carrier member directly contacting the toner flow control member and the toner particles. Additionally, a solid lubricant layer is formed on the portion of the toner flow control member contacting the toner particles on the toner carrier member.

In operation, a toner supply supplies charged toner particles to a toner flow control member. The toner flow control member is disposed between the toner supply and the image support. The toner flow control member directly contacts the toner carrier member on one surface. The toner flow control member creates an electric field to selectively draw charged toner particles through selected, or image, apertures. Since friction between the surface of the toner flow control member directly contacting the toner carrier member and the toner particles is larger than the friction between the surface of the toner carrier member directly contacting the toner flow control member and the toner particles, the attachment force between the toner particles and the toner carrier member is weakened by rubbing and sliding of the toner particles and a portion of the toner particles are removed from the toner carrier member.

Therefore, even control electrodes supplying a low voltage can control the toner flow. Further, a solid lubricant layer at the portion contacting the toner particles on the toner carrier member can make the friction force therebetween small.

BRIEF DESCRIPTION OF THE DRAWINGS

A preferred embodiment of the invention will be described in detail with reference to the figures, in which.

DETAILED DESCRIPTION OF PREFERRED EMBODIMENTS

Figure 1:
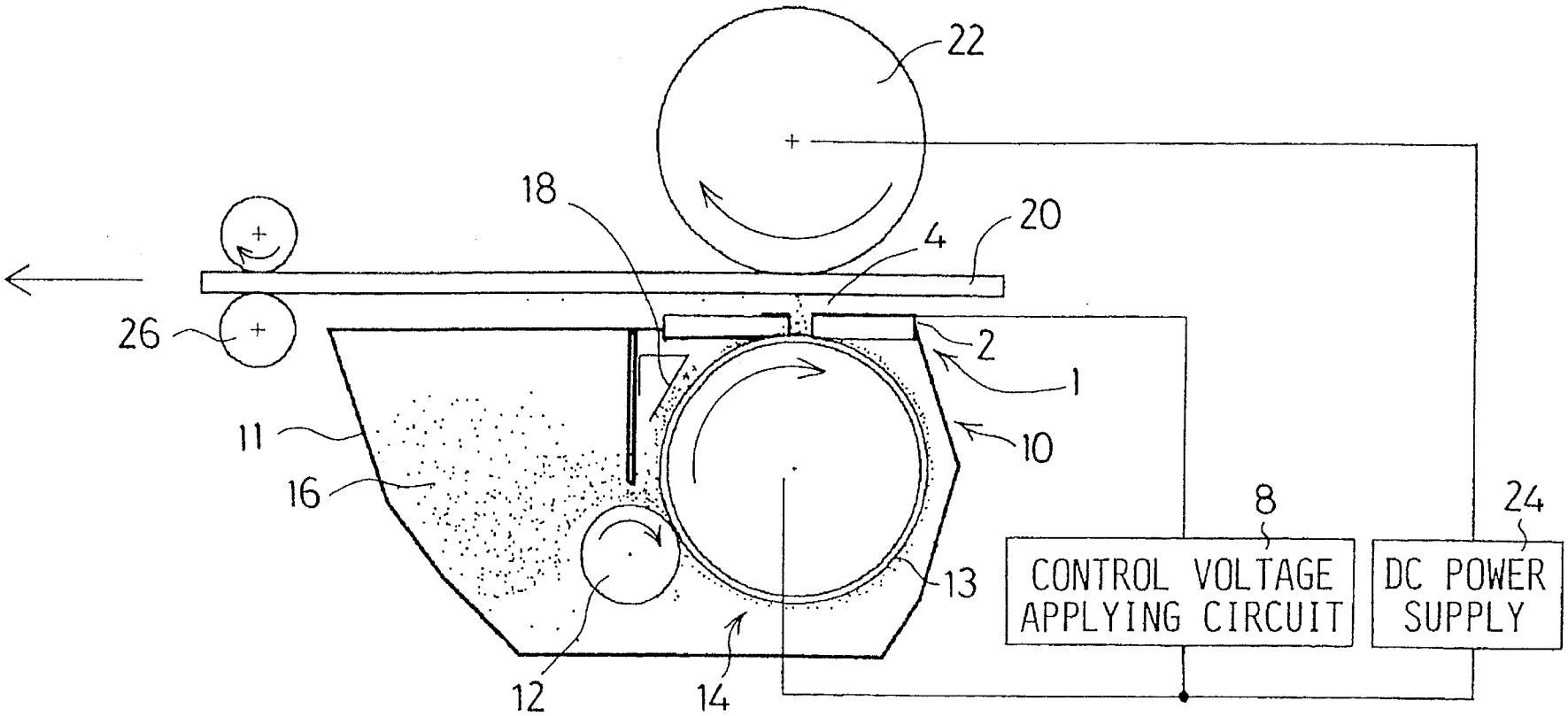
FIG. 1 is a schematic side view in partial section of the image forming apparatus of the preferred embodiment.

Hereafter, a preferred embodiment of the invention will be described with reference to the accompanying drawings. FIG. 1 shows a side, sectional view of the preferred embodiment. A back electrode roller 22 of a cylindrical shape is arranged pivotally on a chassis (not shown) to provide approximately a half millimeter space between the back electrode roller 22 and an upper surface of the aperture electrode member 1. The aperture electrode member 1 includes an insulative sheet 2, preferably a polyimide film. An image supporting medium 20 is inserted into the space between the back electrode roller 22 and the aperture electrode member 1 and transported therethrough. A toner particle supply device 10 is arranged under the aperture electrode member 1 extending in the longitudinal direction of the electrode member 1. In addition, a fixing device 26 is arranged in the transporting path of the image supporting medium 20, which is transferred by the back electrode roller 22.

The toner particle supply device 10 comprises a toner particle casing 11, a supplying roller 12, a toner particle carrying roller 14, and a toner particle layer trimming blade 18. The toner particle carrying roller 14 has low friction layer 13 of a thickness of 5 μm on the surface of the roller which is made of aluminum. The toner particle carrying roller 14 supports toner particles 16 and transfers the toner particles 17 toward the aperture electrode member 1. The low friction layer 13 is a coat in which molybdenum disulfide is dispersed in a binder and a conditioned coating material and then applied to the toner particle carrying roller 14 and baked and cured. The supplying roller 12 supplies toner particles 16 to the toner particle carrying roller 14. The supplying roller 12 and the toner particle carrying roller 14 are rotatably supported by the toner particle casing 11. The rollers 12 and 14 are rotatable in the direction of the arrows shown in FIG. 1. The rollers 12 and 14 are arranged in parallel and contact each other.

The toner particle layer trimming blade 18 contacts the toner particle carrying roller 14 under pressure. The toner particle layer trimming blade 18 adjusts the amount of toner particles 16 carried on the toner particle carrying roller 14 so that the amount of the toner particles is kept uniform on the roller 14 and the blade 18 further uniformly charges the toner particles 16.

Figure 2:
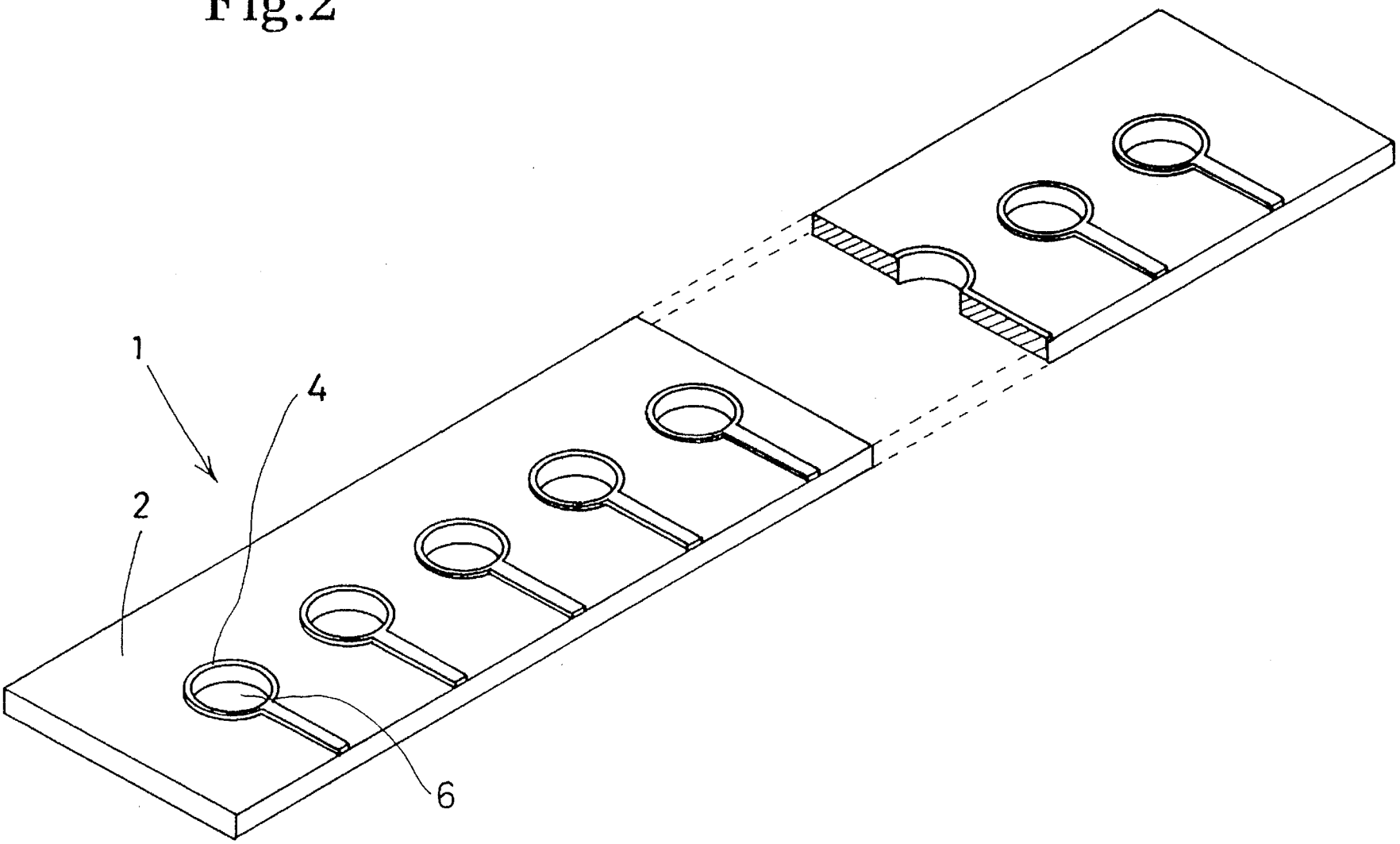
FIG. 2 is a perspective view in partial section showing the structure of the aperture electrode of the preferred embodiment.

A row of apertures 6 is formed in the polyimide insulative sheet 2 of the aperture electrode member 1, as shown in FIG. 2. The diameter of each aperture 6 is preferably approximately 100 μm and the insulative sheet preferably has a thickness of approximately 25 μm. Control electrodes 4, of preferably approximately 1 μμm thickness, are formed around the apertures 6 on the insulative sheet 2.

The aperture electrode member 1 is arranged so that the control electrodes 4 face the image supporting medium 20 and the opposite side of the insulative sheet 2 to the control electrodes 4 contacts the toner particles 16 carried on the toner particle carrying roller 14. The contact is at the position of the apertures.

A control voltage applying circuit 8 is connected between the control electrodes 4 and the toner particle carrying roller 14. The control voltage applying circuit 8 applies a voltage of 0 volt or +50 volts to the control electrodes 4 based on the image signal. Moreover, a DC power supply 24 is connected between the back electrode roller 22 and the toner particle carrying roller 14. The DC power supply 24 applies a voltage of +1 k volts to the back electrode roller 22.

In operation, the toner particles 16 are removed from the supplying roller 12 by rotation of the toner particle carrying roller 14 and the supplying roller 12 in the direction of the arrows shown in FIG. 1. When the toner particles 16 are rubbed with the toner particle carrying roller 14, the toner particles 16 are negatively charged and then supported on the toner particle carrying roller 14. After the supported toner particles 16 are formed as a thin layer by the trimming blade 18 and further charged, the charged toner particles 16 are carried toward the aperture electrode member 1 by the rotation of the toner particle carrying roller 14. The toner particles 16 supported on the toner particle carrying roller 14 are supplied under the apertures 6 while rubbing the aperture electrode member 1.

The toner particles 16 on the low friction layer 13 of the toner particles carrying roller 14 contact the aperture electrodes 1. Since the friction force between the toner particles 16 and the aperture electrodes 1 is larger than the friction force between the toner particles 16 and low friction layer 13, the toner particles 16 on the toner particles carrying roller 14 are rubbed and slide. Some of the toner particles 16 break free. Accordingly, the image-force or Van der Waals force between toner particles 16 and toner particles carrying roller 14 is weakened.

The voltage of +50 volts is applied from the control voltage applying circuit 8 to the control electrodes 4 which correspond to the image portion according to the image signal. As a result, an electric force line toward the toner particle carrying roller 14 from the control electrodes 4 is formed adjacent to the apertures 6 corresponding to the image portion as a result of the potential difference between the control electrodes 4 and the toner particle carrying roller 14. Accordingly, the negatively charged toner particles pass through the apertures 6 from the toner particle carrying roller 14 to the control electrode 4 side. The toner particles 16 drawn to the control electrode 4 side are attracted toward the image supporting medium 20 by the electric field formed between the image supporting medium 20 and the aperture electrode member 1 by the voltage applied to the back electrode 22. The toner particles 16 accumulate on the image supporting medium 20 to form a pixel.

The voltage of 0 volt is applied to the control electrodes 4 corresponding to the non-image area by the control voltage applying circuit 8. As a result, no electric force line toward the toner particles carrying roller 14 from the control electrodes 4 is formed. Accordingly toner particles 16 on the toner particles carrying roller 14 do not pass through the non-image apertures 6 because no electrostatic field exists.

While a row of pixels are formed on the image supporting medium 20 with the toner particles 16, the image supporting medium 20 is fed one pixel at a time in the direction perpendicular to the row of the apertures. Thus, the toner particle image is formed on the image supporting medium 20 by repeating the above described process. Afterwards, the formed toner particle image is fixed on the image supporting medium 20 by the fixing device 26.

It is to be understood that the invention is not restricted to the particular forms shown in the foregoing embodiment. Various modifications and alternations can be made thereto without departing from the scope of the invention encompassed by the appended claims.

For example, while according to the above mentioned embodiment molybdenum disulfide is used in the low friction layer 13 as a lubricant material, other solid lubricants, such as graphite, boron nitride, fluorine resins such as PTFE, and PbO may be used. Also, while the aperture electrode member is used as the electric field control means in the above mentioned embodiment, a mesh electrode member as disclosed in U.S. Pat. No. 5,036,341 or an edge electrode member can be used.

According to this embodiment, a toner supply supplies charged toner particles to a toner flow control member. The toner flow control member is disposed between the toner supply and the image support. The toner flow control member directly contacts the toner carrier member on one surface. The toner flow control member creates an electric field to selectively draw charged toner particles through the apertures. Since the friction between the surface of said toner flow control member directly contacting the toner carrier member and the toner particles is larger than the friction between the surface of the toner carrier member directly contacting the toner flow control member and the toner particles, the attachment force between toner particles and toner carrier member is weakened by rubbing and sliding of the toner particles and some toner particles are freed from the toner carrier member. Therefore, even control electrodes supplying low voltage can control the toner flow. As a result, an inexpensive image forming apparatus capable of forming high quality image forming using a low cost driving element is provided.

What is claimed is:

1. An image forming apparatus, comprising:

a toner carrier having charged toner particles and supplying toner particles, said toner carrier having a surface of a low friction layer;

a toner flow control member having openings therein and control electrodes formed around said openings, said toner flow control member controlling a flow of the charged toner particles from said toner carrier through said openings with an electric field and said toner flow control member directly contacting said toner carrier; and a back electrode confronting said toner flow control member and attracting charged toner particles that have passed through said openings, wherein said back electrode and said toner flow control member are positioned to sandwich an image receiving medium therebetween and said low friction layer comprises molybdenum disulfide, graphite, baron nitride, fluorine resin or PbO.

2. A image forming apparatus as claimed in claim 1, wherein said toner carrier is a roller, said low friction layer is disposed on the surface of the roller and directly contacts said toner flow control member.

3. A image forming apparatus as claimed in claim 2, wherein the thickness of said low friction layer is approximately 5 μm.

4. A image forming apparatus as claimed in claim 1, wherein said toner carrier further comprises:

a toner particles casing that stores toner particles;

a toner carrier roller rotatably mounted in said toner particles casing that receives toner particles from said toner particles casing and transports the toner particles to said toner flow control member; and a toner trimming blade disposed adjacent to the toner particles carried by said toner carrier roller.

5. A image forming apparatus as claimed in claim 1, further comprising:

a voltage supply coupled to said control electrodes to selectively supply a voltage to said control electrodes; and a power supply coupled to said back electrode to supply a voltage to said back electrode.

6. A image forming apparatus, comprising:

a toner supply that supplies charged toner particles, including a toner carrier member;

an image support that supports an image formed of charged toner particles based on image data; and a toner flow control member disposed between said toner supply and said image support, said toner flow control member directly contacting said toner carrier member on one surface, said toner flow control member including a plurality of apertures surrounded by control electrodes that create an electric field to selectively draw charged toner particles through said apertures, wherein a friction force between said toner flow control member and the toner particles is larger than a friction force between said toner carrier member surface and the toner particles.

7. A image forming apparatus as claimed in claim 6, wherein said toner carrier member comprises a low friction layer disposed on the surface directly contacting said toner flow control member.

8. A image forming apparatus as claimed in claim 7, wherein said low friction layer is made of molybdenum disulfide.

9. A image forming apparatus as claimed in claim 7, wherein said low friction layer comprises graphite, baron nitride, fluorine resin or PbO.

10. A image forming apparatus as claimed in claim 7, wherein said toner carrier member is a roller and said low friction layer is disposed on the surface of the roller.

11. A image forming apparatus as claimed in claim 7, wherein the thickness of said low friction layer is approximately 5 μm.

12. A image forming apparatus as claimed in claim 6, wherein said toner carrier further comprises:

a toner particle casing that stores the toner particles;

a toner carrier roller adjacent to said toner particles casing that receives the toner particles from said toner particle casing and transports the toner particles to said toner flow control member; and a toner trimming blade disposed adjacent to the toner particles carried by said toner carrier roller.

13. A image forming apparatus as claimed in claim 6, further comprising:

a voltage supply coupled to said control electrodes to selectively supply a voltage to said control electrodes; and a power supply coupled to said back electrode to supply a voltage to said back electrode.

14. An image forming apparatus, comprising:

toner charging means for charging toner particles;

toner flow control means having openings therein and control electrodes formed around said openings, said toner flow control means for controlling a flow of the charged toner particles;

toner carrying means for carrying charged toner particles charged by said toner charging means, a surface of said toner carrying means comprising a low friction means directly contacting said toner flow control means;

image support means for supporting image data formed of charged toner particles based on the image data; and back electrode means confronting said toner flow control member, said back electrode means for attracting charged toner particles that have passed through said openings, wherein said back electrode and said toner flow control member are positioned to sandwich an image support means therebetween and the tower flow control means controls the flow of the charged toner particles from said toner carrier means through said opening with an electric field and wherein said low friction means is made of a material selected from the group consisting of molybdenum disulfide, graphite, baron nitride, fluorine resin and PbO.

15. A image forming apparatus as claimed in claim 14, wherein said toner carrier means is a roller and said low friction means is disposed on the surface of the roller.

16. A image forming apparatus, comprising:

toner charging means for charging toner particles;

toner flow control means having openings therein and control electrodes formed around said openings, said toner flow control means for controlling a flow of the charged toner particles;

toner carrying means for carrying charged toner particles charged by said toner charging means, wherein a friction force between said toner flow control means surface and the toner particles is larger than a friction force between said toner carrying the surface and the toner particles;

image support means for supporting image data formed of charged toner particles based on the image data; and back electrode means confronting said toner flow control member, said back electrode means for attracting charged toner particles that have passed through said openings, wherein said back electrode and said toner flow control member are positioned to sandwich an image support means therebetween and the toner flow control means controls the flow of the charged toner particles from said toner carrying means through said opening with an electric field.

* * * * *